US005402850A

United States Patent [19]

Lalande et al.

[11] Patent Number: 5,402,850

[45] Date of Patent: Apr. 4, 1995

[54] METHODS OF USING REVERSE CIRCULATING TOOL IN A WELL BOREHOLE

[76] Inventors: Phillip T. Lalande; H. Madeley, Jr., both of P.O. Box 52807, LaFayette, La. 70505

[21] Appl. No.: 182,793

[22] Filed: Jan. 13, 1994

[51] Int. Cl.[6] ..... E21B 31/08

[52] U.S. Cl. ..... 166/301; 166/312; 166/99

[58] Field of Search ..... 166/301, 312, 376, 99, 166/171

[56] References Cited

U.S. PATENT DOCUMENTS

| | | | |
|---|---|---|---|
| 3,809,161 | 5/1974 | Carothers | 166/99 X |
| 4,603,739 | 8/1986 | Krugh | 166/99 X |
| 5,176,208 | 1/1993 | Lalande et al. | 166/99 |
| 5,228,508 | 7/1993 | Facteau et al. | 166/312 X |

FOREIGN PATENT DOCUMENTS

| | | | |
|---|---|---|---|
| 565985 | 7/1977 | U.S.S.R. | 166/99 |
| 991023 | 1/1983 | U.S.S.R. | 166/99 |

*Primary Examiner*—William P. Neuder

*Attorney, Agent, or Firm*—Gunn & Kuffner

[57] ABSTRACT

A reverse circulation procedure is set forth in which selected shoes are attached to a reverse circulation tool. Debris, junk and other trash accumulating in a well borehole is captured and removed. The circulation delivers fluid flow in the annular space downwardly at the bottom of the tool of the present disclosure which is directed in the vicinity of a shoe affixed to the lower end. Trash or debris is captured by this process. In one instance, the trash is captured in an elongate container below the reverse circulation tool. In another instance, the trash is collected within the tool itself. The tool has a fluid flow path through an inner tube which is selectively perforated and which directs flow upwardly to one or more deflectors to assure that junk or trash does not flow through the tool.

11 Claims, 2 Drawing Sheets

METHODS OF USING REVERSE CIRCULATING TOOL IN A WELL BOREHOLE

BACKGROUND OF THE DISCLOSURE

After a well has been drilled and completion is accomplished by cementing a casing string in the well, various operating procedures are performed in the cased well over a period of time. For instance, equipment may be installed in the well to operate in a first state of affairs for a long interval. Nevertheless, as the well ages, the producing formation becomes depleted and it becomes necessary to change, modify or alter the location or nature of the equipment installed in the completed well. Consider as an example a well which passes through two or three different productive formations. If the most productive formation occurs at a relatively shallow horizon, it may be appropriate to pack off that strata with a bridge plug or packer below that formation, perforate casing at that formation, and isolate that formation with a second packer above the formation. The packers are installed in the well by wedging the packers against the casing. Ultimately, should that formation be depleted, it will then be necessary to remove the two packers, plug the various perforations, and direct completion procedures to another formation at a greater depth. Then, it will be necessary to mill out or otherwise remove the two packers. When this is needed, the packers are milled to destroy them. They create substantial debris. The debris from destruction of the packers gets in the way of subsequent procedures.

It is desirable to keep the cased well borehole free of the debris so that subsequent well completion can be accomplished without impediment from the scattered pieces of debris which are collected along the cased well borehole. One way of doing this is to simply drill through the packers and let the debris fall to a great depth in the well. This is acceptable if the well is sufficiently deep. However, there are times when that is not an acceptable process. It may be important to remove the debris. The procedure for accomplishing this is set forth hereinbelow and especially utilizes the reverse circulating tool set forth in the disclosure which is U.S. Pat. No. 5,176,208. That is a device which enables well completion procedures to be carried out with a view of collecting the trash and debris in the tool. However, it requires use of the reverse circulation tool in conjunction with cooperative apparatus so that the correct and varied removal procedures can be implemented. More specifically, the reverse circulation tool of the present disclosure is able to collect debris with cooperative equipment so that the necessary retrieval procedure can be implemented without difficulty.

One approach in the use of this tool involves utilization of an external rubber skirt which isolates fluid flow in the annular space on the exterior of the reverse circulating tool. This external flow cooperates with a burning shoe which cuts metal parts on the interior of the cased well and helps collect that debris or junk in the tool interior. In another aspect, the reverse circulation tool of the present disclosure can be used with a tool supported packoff rubber skirt to divert and assure external fluid flow in the annular space around the tool downwardly and back up through the tool. This can be used with a finger shoe so that debris is also collected and held in the circulating tool of the present disclosure. In another aspect, junk collected in the bottom of a cased well can be collected using an alternate type shoe fitted at the lower end of the reverse circulating tool. This is particularly able to be used to remove debris from the well borehole. In addition, it can be used adjacent to perforations through the casing so that the casing adjacent the perforations can be washed. This will typically remove some of the trash and other debris in the perforations to a certain depth. Other procedures can also be implemented as set forth hereinbelow for the primary purpose of removing the junk that is collected in the well after destruction of items in the cased well.

BRIEF SUMMARY OF THE DISCLOSED APPARATUS

The present apparatus is briefly summarized as incorporating a reverse circulating tool in accordance with U.S. Pat. No. 5,176,208 and further incorporates an external fluid flow deflector made of rubber typically installed at the upper end. In addition, a deflector of perforate construction is installed at a mid-point in the tool to assure that trash and debris is collected in the desired chamber of the tool. In addition, there is an inner tube which is perforated with one or more perforations to assure fluid flow circulation in an area where trash and debris is captured and stored for retrieval to the surface. There are different shoes attached at the lower end for operation in several junk retrieval procedures.

DRAWINGS

So that the manner in which the above recited features, advantages and objectives of the present invention are attained and can be understood in detail, a more particular description of the invention, briefly summarized above, may be had by reference to the embodiment thereof which is illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
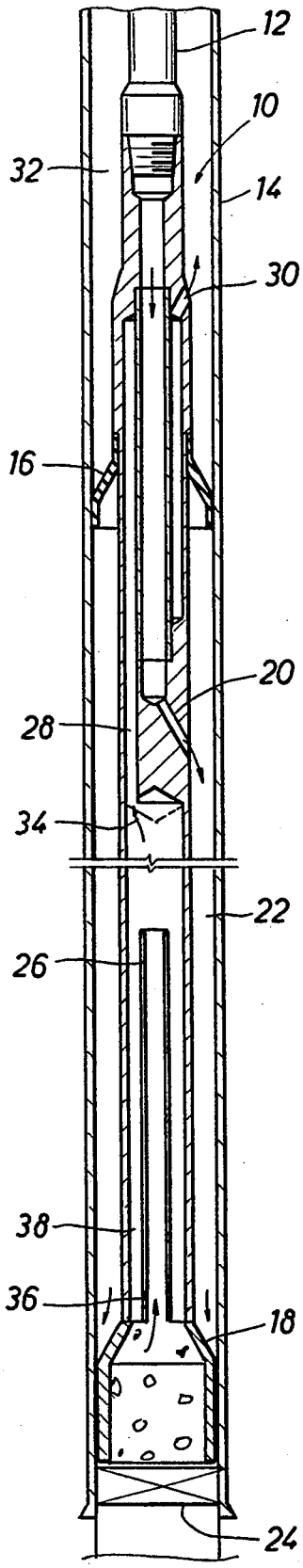
FIG. 1 is a sectional view through the reverse circulating further incorporating an external fluid flow deflector formed of rubber at the upper end and a shoe attached to the lower end to enable collection of debris which is accumulated in the reverse circulating tool.

In the drawings, attention is first directed to FIG. 1 of the drawings which shows the reverse circulation tool 10 suspended on a tubing string 12 for removal of trash and debris in the well borehole. In this instance, it is used in a cased well which is defined by the casing 14. The tool 10 is provided with an external rubber flap or wiper 16 which flares outwardly to serve as a mechanism for isolating the fluid flow area. More particularly, the rubber skirt 16 extends outwardly so that fluid flow is isolated in the region below the rubber skirt. The tool 10 is likewise provided with a shoe 18 at the lower end. In this particular embodiment, a representative shoe is the type D burning shoe which cuts the metal and rubber of a packer or other obstacles in the cased well. The type D shoe is provided as one embodiment by the Bowen Tool Company, Houston, Tex.

Consider fluid flow during operation of this arrangement. Fluid flow under pressure is directed downwardly through the tubing string 12 and flows through the central passage in the tool 10 and is then directed to the exterior at the port 20. This introduces fluid flow into the annular space 22 on the exterior of the tool 10. The fluid flow is directed downwardly to packer 24 which isolates a zone in the well. Downward flow is directed upwardly as indicated by the arrow through the inner tube 26. Fluid flow continues upwardly through the tool passage 28 and then through the port 30 and into the annular space 32. This annular space provides a return flow path to the surface of the well. The entire flow path through the tool 10 is set forth in the specification of the above-mentioned patent. The present disclosure contemplates the incorporation of a deflector shield in the tool 10 just above the inner tube 26. The deflector shield 34 is formed with a set of perforations so that fluid is readily able to flow through it. In the preferred embodiment, the tube 26 is perforated at one or more openings exemplified at 36. This tube defines a surrounding trash receiving chamber 38 in the lower part of the tool 10.

Consider now the procedure in which an upper packer (defining a zone) is milled from the cased well and is retrieved in the manner suggested by FIG. 1 of the drawings. First of all, the milling procedure is carried out and trash is permitted to collect on the lower packer 24. Trash in this area accumulates until milling is completed. Thereafter the milling tool is removed from the well borehole and the reverse circulation tool 10 of the present disclosure is lowered in the cased well 14. It is equipped with the externally extending rubber skirt or deflector 16 at the upper end. This skirt isolates the region so that fluid flow is along the path indicated by the arrows in FIG. 1. In addition to that, it assures that the fluid flows in the area of the burning shoe 18 affixed to the lower end of the cutting 10. Fluid flow in this area picks up the junk made by the milling process. The junk is carried by the fluid flow through the inner tube 26. Junk is limited in its upward travel by the deflector 34. This causes the junk to fall or otherwise settled downwardly. Because there is a relatively rapid flow of drilling fluid up through the tube 26, junk is forced into the annular storage space 38 and settles in that space. There is a modest downwardly flow gradient in the chamber 38 as some of the fluid flows down and through the port 36. Fluid is pulled from the port 36 into the inner tube 26 by the velocity of the fluid flow upwardly in that tube. This draws the trash and debris into the chamber 38 and stores it in that chamber. In effect, circulation along this indicated pathway is accomplished using one or more ports 36 to assure that the trash and debris is packed in the area 38 for easy retrieval at the surface. In effect, this assists in accumulating the debris in a single location. After a sufficient interval of circulation, the debris which is in the well can then be retrieved in this chamber with the tool 10.

The remedial procedure sometimes involves drilling out or cutting out the packer in the cased well. The usual mode of construction of packers defines an upper end with a thick encircling shoulder above a central inflatable element. Normally, it is not necessary to destroy by milling the entire packer. The milling process involves milling the upper end, cutting away the outer periphery of the upper end and thereby cutting away sufficient material to cause packer release. The milling process may involve telescoping over the packer to also mill the lower end of the packer. The grip of the lower end of the packer is similar, or identical, to that of the upper end. In summary, both ends of the packer are milled on the exterior to decrease packer diameter for release. The entire packer assembly can be removed after release as a unit. This reducing the quantity of milled junk formed in the well.

After milling the packer can be removed as a unit, leaving little junk in the well above the packer 24. Generally, the milling process cooperates with a fluid flow which washes the cuttings away from the immediate area so that the milling process can be completed.

Figure 2:
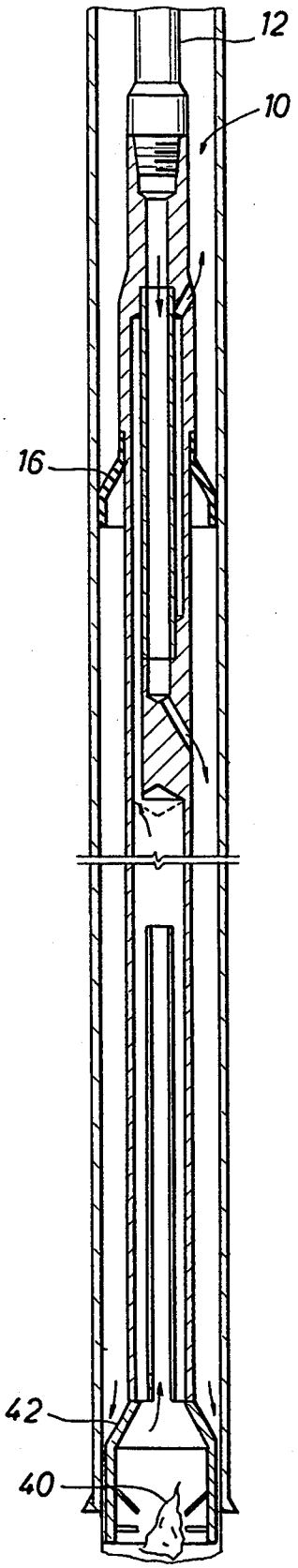
FIG. 2 is a view similar to FIG. 1 showing an alternate method of application in which the reverse circulating tool is used with a different type shoe for collection of a larger piece of junk in the well borehole.

Going now to FIG. 2 of the drawings, an alternate construction of the tool 10 is incorporated. Again, the tool 10 is lowered in the well borehole on the tubing string 12 to engage a large piece of trash which is sometimes known as a fish. In this view, the fish 40 is shown at the bottom of the well captured in a finger shoe 42. One shoe is provided by the Bowen Tool Company, Houston, Tex. In this instance, the shoe is equipped with a number of whiskers or fingers which extend inwardly. As the fish is forced up into the shoe, the fish is held by the several fingers which poke and jam against the fish 40 from a variety of directions. This assures that the fish is grasped by the shoe 42 on the lower end of the tool 10. More particularly, in this deployed construction, the fluid flow on the exterior in the annular space and outside the tool 10 is directed down and back up through the shoe 42. The fluid flow tends to centralize the fish 40 and may even lift the fish depending on the velocity of the fluid flow. The orientation of fish and related details cannot necessarily be known at the surface. The fluid flow is helpful in retrieval of the fish 40. The fish is thus grasped in the throat of the shoe 42. Again and is noted with FIG. 1, the rubber deflector 16 assures that fluid flow is kept in this region and is isolated from the return pathway back to the surface which pathway is above the rubber deflector 16. In one mode of operation, the tool 10 of FIG. 2 is placed in the well borehole with the shoe 42 attached and circulation is begun after the shoe has fitted over the top end of the fish. If the fish is not stuck or otherwise attached, it often can be retrieved by grasping the fish in the shoe 42.

Figure 3:
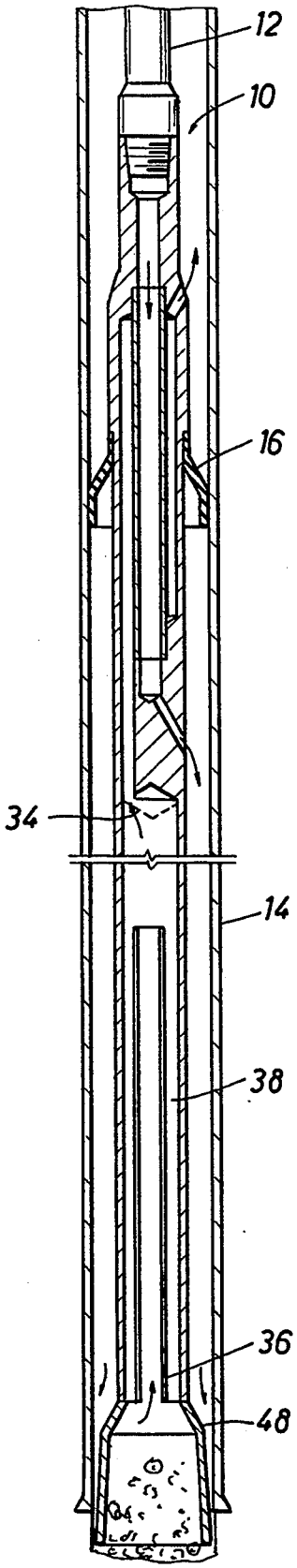
FIG. 3 is a view similar to FIGS. 1 and 2 showing further modification of the apparatus by the incorporation of a different type shoe to collect junk and debris from a different remedial procedure.

Attention is now directed to FIG. 3 of the drawings which shows another embodiment. In FIG. 3 of the drawings, the reverse circulating tool 10 again is provided with the rubber deflector 16. It is used in a cased well borehole supported on the tubing string 12 as before. Fluid flows in the same direction as FIGS. 1 and 2 and as indicated by the arrows in FIG. 3 of the drawings. The embodiment of FIG. 3 is similar to the embodiment shown in FIG. 1 in that a deflector 34 is again installed in the tool 10 to assure that debris does not go upwardly beyond the area where it is intended to be captured. More particularly, the device is equipped with a type A shoe provided by Bowen and which is indicated by the numeral 48. This shoe is particularly useful to pickup trash at the very bottom of the well, even below the casing 14. Moreover, the fluid flow path is particularly intended to stir and agitate the trash in that region. The rubber deflector 16 keeps the debris from traveling excessively high in the tool. As desired, a set of perforations at 36 is included to enable a reverse fluid flow path to assure that the trash and debris is accumulated in the space 38, the annular space just outside the inner tube 26. It is especially useful to remove a large quantity of small pieces of debris which may accumulate over a number of years or may accumulate from a single milling operation to destroy some type of plug or obstacle in the casing. It particularly is advantageous when used at the maximum depth of the well borehole.

Figure 4:
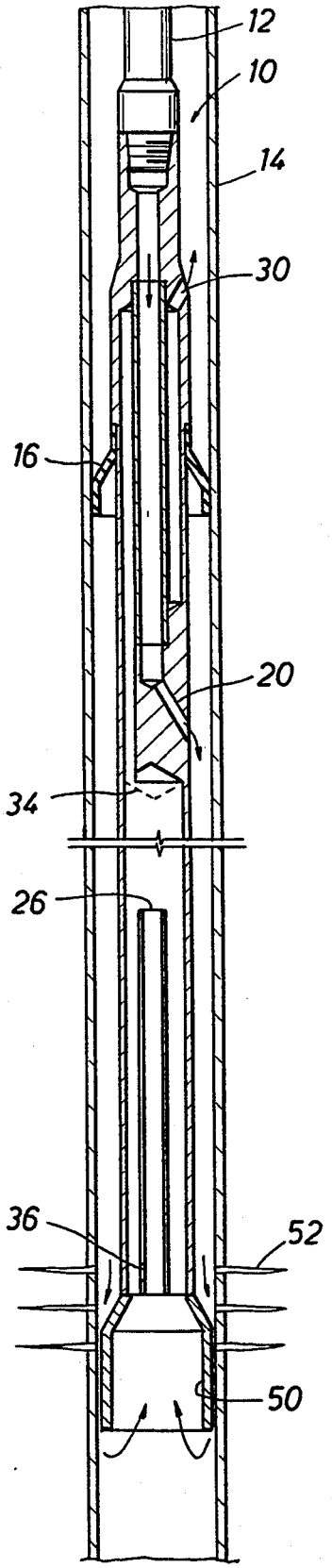
FIG. 4 is a view showing the use of the reverse circulation tool with a different type shoe where the device is positioned adjacent to perforations to wash the area of the perforations.

Going now however to FIG. 4 of the drawings, an alternate use of the present apparatus is set forth. It particularly is useful in a well that has been perforated. Here, the numeral 10 again identifies the reverse circulation tool. It is supported on the tubing string 12 in a cased well 14. The fluid deflector 16 again is included to assure that fluid is isolated to flow in the pattern indicated by the arrows of FIG. 4 of the drawings. As before, fluid flows downwardly through the tubing string 12 and is introduced to the annular space below the deflector 16 where the fluid flows to the exterior to the port 20. The port to the exterior delivers the fluid in the annular space 22. Fluid flows downwardly to the shoe 50 which is affixed to the embodiment illustrated in FIG. 4 of the drawings. Fluid is permitted to flow upwardly into the tool in the same fashion as before and ultimately flows through the tool 10 back through the outlet port 30 and is returned to the surface on the annular volume on the exterior of the tubing string 12.

In this particular instance, the well has been perforated by a set of perforations indicated at 52. The perforations extends through the casing. They are formed by shaped charges which are detonated to form the perforations through the casing 14, through the surrounding cement around the well borehole and into the formations with the hope of producing through the perforations into the cased well borehole. It is helpful to wash the region of the perforations. The fluid flow in the region of the perforations helps to remove large pieces of trash, gravel and debris from the area. FIG. 4 shows the fluid flow path immediately past the perforations 52 so that trash in the area can be cleared. These perforations are located in a zone defined by a packer in the casing.

The procedure involved with the tool 10 shown in FIG. 4 of the drawings needs to be placed in context. After the well has been completed, packers are set below the formation and perforations are formed. When the perforations are formed, they are located above the lower packer which isolates that production zone. After the perforating step, substantial trash is formed in the well borehole. It may be necessary to wash the perforations several times. On each operation of the tool 10, it is filled with sand, gravel, slag and other debris liberated by the perforating process. Obviously, when perforations are needed, they are typically quite numerous. After perforating the cased well, washing removes the trash to enhance production. The procedure shown in FIG. 4 of the drawings involves placing the tool 10 in the immediate vicinity of the perforations so that the fluid flow immediately in the area of the perforations washes the perforation areas. This typically will clear the openings and remove a substantial portion of perforation debris including sand and gravel from the perforations. That can be collected in the tool 10. In a fashion similar to FIG. 1, the washing process again uses a deflector which is installed above the inner tube 26. In this instance, a deflector 34 is incorporated. Trash again collects in the annular space on the outside of the inner tube 26. As before, an optional set of perforations 36 is included to drain the area on the exterior of the inner tube 26 to provide a fluid flow path.

Figure 5:
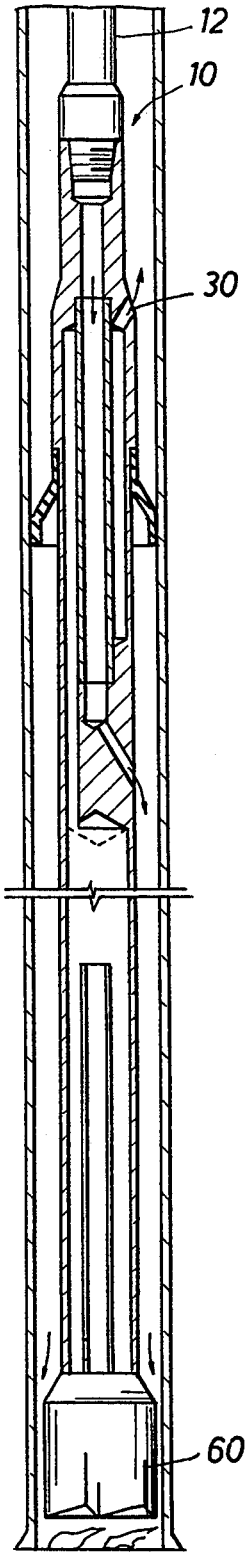
FIG. 5 is a view similar to the other views in which a different type shoe is affixed to carry out a different debris collection procedure.

In FIG. 5 of the drawings, the tool 10 is installed on the tubing string 12 for use with a junk mill 60 which is appended to the tool 10. Junk mill 60 is used to retrieve large pieces of junk. In this particular instance, the mill is provided with suitable ports through the mill to cooperate with the reverse circulation pattern which is controlled by the tool 10 of the present disclosure. More importantly, it is affixed to the bottom end for removal of junk which accumulates in the well borehole including large pieces of junk. Sometimes when a milling process is used to remove a packer, after partial milling of the packer, the remaining components will breakup and fall to the bottom. This typically will leave fewer pieces but pieces of larger and more complex construction. The milled pieces may still hold together at the bottom. In any case, a typical Bowen junk mill can be used. It is normally provided with ports through the mill to enable the reverse circulation flow path to be extend through the mill. There is a substantial advantage to operating the junk mill 60 with the reverse circulation flow path resulting from the use of the tool 10 and the procedure which is taught in the present disclosure.

Figure 6:
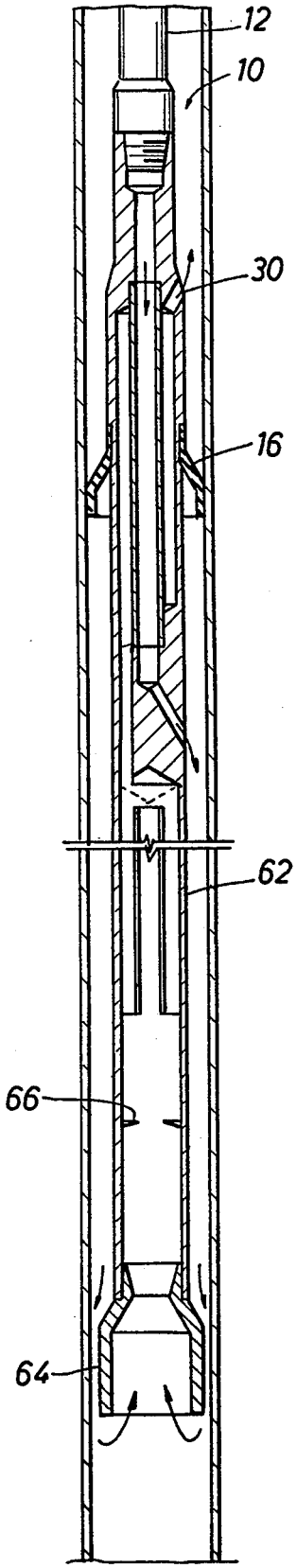
FIG. 6 is another view showing another type of shoe affixed to the system which includes a lower trash storage chamber which operates in a somewhat different fashion.

Going now to FIG. 6 of the drawings, another procedure is suggested with this apparatus. As before, the reverse circulation tool 10 is provided with a rubber deflector 16. This defines the reverse circulation flow path around the tool 10. The tool 10 is in this instance provided with a junk retaining assembly having the form of an elongate sub 62. The sub terminates at a burning or wash shoe 64 at the lower end. In addition, there is a junk retaining assembly 66 on the interior which extends partially inwardly to serve as a catch mechanism to assure that junk and other trash is caught in the tool. In this particular instance, it is used with the tubing string 12 to locate the reverse circulation tool 10 at the desired depth in the well borehole. Reverse circulation is initiated. Some and hopefully all of the debris will be directed upwardly through the shoe 64. It is captured on the interior of the sub 62. The upward fluid flow carries the junk to the height in the tool so that it is caught by a protruding finger or other catching means 66 so that it does not thereafter fall out of the device when the fluid flow velocity is reduced.

This particular procedure enables long spiral shavings from a metal cutting tool to collect on the interior. The fluid flow carries the cuttings upwardly into the chamber or sub 62. They typically form a bird nest in the area. If the metal is of sufficient ductility that it will not break, then the shavings may form long tangled spirals which tend to knot together and thereby enable easy removal of several shavings which often collect in a bird nest near the bottom of a well, or perhaps even higher where the bird nest will snag and not fall to the bottom. When snagging occurs in this fashion, it is very difficult to remove and poses substantial problems to clearing the well borehole. In summary, the embodiment shown in FIG. 6 is used particularly for removing long, stringy, tangled, spiral shavings which cluster together and which otherwise form a nest which tends to block the fluid flow through the producing well.

The present disclosure sets forth a number of methods in which reverse circulation is useful for clearing the area of a well after milling removes previously installed plugs and the like. The devices are milled, and then the debris or trash collects at the bottom area. It is captured by the reverse circulation tool equipped with the rubber deflector to isolate and quarantine the reserve circulation flow path.

In summary, the foregoing is directed to the preferred embodiment including several methods of operation, but the scope is determined by the claims which follow.

We claim:

1. A reverse circulation procedure for use in a well borehole which removes trash and includes the steps of:

a) lowering a reverse circulation tool on a tubing string into a well borehole;

b) forming a fluid flow path so that fluid can be pumped along the tubing string in a well borehole and flow into the reverse circulation tool includes through ports which direct flow from the interior of the tool to the exterior so that the fluid flow is directed downwardly in the annular space around the tool;

c) defining a fluid flow path back through the bottom portions of the tool and upwardly into the tool so that the upward flow path helps evacuate fluid from around the tool;

d) directing with an external resilient annular member the externally located downward flow around and back into the tool;

e) incorporating a shoe at the lower end of the tool so that the reverse circulation is directed upwardly and into the shoe for fluid return; and f) moving trash with fluid flow so the trash enters the shoe carried by the fluid flow for storage and retrieval.

2. The method of claim 1 including the preliminary step of attaching a circulating shoe equipped with milling teeth to the lower end of the tool and then milling in the well borehole to form trash from milling.

3. The method of claim 1 including the preliminary step of attaching a circulating shoe with fingers to grasp trash or debris in the well borehole for retrieval, wherein the trash is a fish.

4. The method of claim 3 including the step of positioning the shoe over the fish, and then circulating to enable fluid flow to assist in fish retrieval.

5. The method of claim 4 including the step of retrieving the fish in the shoe.

6. The method of claim 1 including the step of installing on the exterior of the reverse circulation tool the resilient annular member prior to lowering the tool in the well borehole.

7. A method of washing a set of perforations in a well borehole comprising the steps of:

a) running a reverse circulation tool in a well borehole having a casing therein and in which a set of perforations are formed at a zone into a formation and in which perforations related trash is formed;

b) directing a fluid flow along a tubing string into the well borehole and through the reverse circulation tool to enable fluid flow downwardly in an annular space around the tool;

c) washing the perforations with the downward flow in the annular space around the tool; and d) returning the wash fluid flow to the surface by directing the downward wash fluid flow into an opening on the lower portions of the reverse circulation tool and then upwardly into the tool and out of the tool into a flow path along the cased well borehole.

8. The method of claim 7 including the step of packing the well borehole below the perforations, isolating trash from the perforation process in the well borehole and removing trash with the wash fluid flow upwardly into the tool.

9. The method of claim 8 including the step of directing the wash fluid flow into the tool so that trash is enabled to settle in the tool and is collected in a designated area in the tool.

10. The method of claim 9 further including the step of retrieving the tool after washing so that trash is received from the perforated well borehole.

11. The method of claim 10 including the further step of collecting the trash in the tool while directing wash fluid flow downward and around said tool to enable trash removal from the perforations.

* * * * *